United States Patent [19]

Schultz et al.

[11] Patent Number: 4,735,347

[45] Date of Patent: Apr. 5, 1988

[54] SINGLE PUFF ATOMIZING PUMP DISPENSER

[75] Inventors: Robert S. Schultz, Old Greenwich; Louis Meshberg, Trumbull, both of Conn.

[73] Assignee: Emson Research, Inc., Bridgeport, Conn.

[21] Appl. No.: 738,579

[22] Filed: May 28, 1985

[51] Int. Cl.[4] ..... B05B 11/00

[52] U.S. Cl. ..... 222/321; 222/385

[58] Field of Search ..... 222/263, 321, 341, 380, 222/383, 385, 372, 373, 376, 378, 382; 239/333

[56] References Cited

U.S. PATENT DOCUMENTS 4,113,145 9/1978 Meshberg ..... 222/321 X 4,274,560 6/1981 Cater ..... 222/321

4,389,003 6/1983 Meshberg ..... 222/321

4,511,069 4/1985 Kalat ..... 222/321 X

*Primary Examiner*—Joseph J. Rolla

*Assistant Examiner*—Kevin P. Shaver

*Attorney, Agent, or Firm*—Kenyon & Kenyon

[57] ABSTRACT

A pump for use with a container of liquid material for dispensing and or atomizing the liquid material in an accurate dose. The apparatus has a movable valve member which is normally biased in a closed position. Upon actuation of the pump, a fluid pressure is caused to act upon the valve member. The ratio of the area of the valve member against which the pressure acts before and after opening of the valve member is selected to be at least 1:1.5, to cause a corresponding reduction of the force necessary to open the valve and dispense the fluid upon actuation, resulting in a full stroke and single puff each time.

20 Claims, 2 Drawing Sheets

SINGLE PUFF ATOMIZING PUMP DISPENSER

BACKGROUND OF THE INVENTION

This invention relates to atomizing pump dispensers in general and more particularly to an improved single puff prepressure pump.

Various types of atomizing pump dispensers have been developed. The majority of these pump dispensers include a pump body in which there is formed a pump chamber, a piston disposed for reciprocal movement within the pump chamber a dispensing stem operatively coupled to the piston and adapted to receive an atomizer head, and valve means for selectively bringing the pump chamber in and out of communication with the container on which the pump is mounted. Typically, a check valve such as a ball check valve is utilized. During the dispensing stroke the pressure developed within the pump chamber closes the check valve so that material is forced out through the stem and atomizer. After dispensing, as the piston is returned to its normal position by biasing means such as a spring, the check valve opens to permit the pump chamber to refill.

However, pumps have also been developed which do not utilize such a check valve. Typical of this type of pump is that disclosed and claimed in U.S. Pat. No. 4,113,145, the disclosure of which is hereby incorporated by reference. In the pump disclosed therein, a throat is formed at the bottom of the pump chamber. Upon actuation of the dispensing stem, a cylindrical member makes a positive surface to surface seal with the throat to seal off the chamber from a dip tube in communication with the container. On the return stroke of the piston, the cylinder remains empty until the member making the seal reaches almost its fully raised position whereupon communication is again established between the pump chamber and the container permitting the chamber to refill. Such pumps avoid problems which accompany ball check valves, e.g. sticking, etc.

The same manner of sealing the pump chamber is described in U.S. Pat. No. 4,274,560 in conjunction with a prepressurized pump. In the pump of the aforementioned U.S. Pat. No. 4,113,145, and in a number of the embodiments of U.S. Pat. No. 4,274,560 the throat at the inlet to the pump chamber is formed by molding the throat as part of the pump body. However, in FIG. 4 of U.S. Pat. No. 4,274,560, an alternative manner of sealing is disclosed. This alternative manner comprises forming the throat by means of a flexible insertable seal. This permits making the seal member, which is inserted into the pump chamber, of a softer plastic material than the pump body itself and softer than the cylindrical member with which it makes a seal so as to obtain a better sealing effect.

Another pump of this general type is disclosed in British Patent No. 1,486,236, in which a check valve is formed at the inlet to the pump chamber by an elastic ring closely and slidably fitted on a valve rod movable between two positions as defined by a cavity member having an annular recess larger than the outside diameter of the elastic ring.

Conventional pumps and pumps such as the type of U.S. Pat. No. 4,113,145 rely upon the operator moving the actuator and stem smoothly and firmly in order to get atomization. If the operator does not move the actuator quickly enough and smoothly enough the result is dribble.

With the recognition of the problems of pressurized atomizing dispensers releasing Freon gas into the atmospere, there was an increase in demand for a better atomizing pump dispenser which did not result in this dribble. A type of pump that accomplishes this is what is known as the prepressure pump, such as the pump of U.S. Pat. No. 4,274,560 and British Patent No. 1,486,236. A pump of this nature was first described in U.S. Pat. No. 3,399,836, which was reissued as U.S. Pat. No. Re. 28,366. Other patents of similar construction include U.S. Pat. Nos. 3,414,169, 4,144,987, 4,051,983, 4,025,046, French Pat. Nos. 2,314,772, 2,305,241, British Pat. No. 1,508,572, U.S. Pat. Nos. 4,089,442 and 4,122,982.

Such a pump is also described in U.S. Pat. No. 4,230,242. In this pump, a ball check value is formed within a valve actuator member to permit refilling of the pump immediately at the beginning of the return stroke.

U.S. Pat. No. 4,389,003, the disclosure of which is is hereby incorporated by reference, also permits immediate refilling through the use of a sliding inlet seal. That is to say, it has a flexible insertable seal such as the one in FIG. 4 of U.S. Pat. No. 4,274,560, which is slidable and which slides to open channels to permit immediate refilling of the pump.

The aforementioned prepressure pumps, as with basic atomizing pumps include a pump body in which there is formed a pump chamber, a piston disposed for reciprocal movement within the pump chamber, a dispensing stem operatively coupled to the piston and adapted to receive an atomizer head, and valve means for selectively bringing the pump chamber in to and out of communication with the container on which the pump is mounted. However, in the case of prepresure pump, the valve means comprises a valve member which in addition to sealing the inlet to the pump chamber during operation has a portion which seals the outlet from the pump chamber through the dispensing stem. The biasing means, which in conventional pumps biases the piston directly, in the prepressurized pump act against the valve member, sealing the valve member against the outlet through the dispensing stem and thereby also biasing the piston outwardly. This valve member, typically of a cylindrical shape, of course, occupies some volume of pump chamber.

In operation, when the user presses down on an actuator on the end of the pump stem, this pressure is transmitted to the piston. As a result, pressure builds up within the chamber, the pressure being equal to the available piston area times the force applied by the operator. Since the liquid within the pump chamber is not compressible, this hydraulic pressure also acts on the valve member. The inward force excerted on the valve member is equal to the pressure times its area available to the fluid. This force acts against the spring which is biasing the valve member outwardly. When the pressure in the chamber builds up to the point that the force generated overcomes the spring force, the valve member moves inwardly opening the outlet in the dispensing stem and permitting the fluid to flow out through the actuator which typically is a mechanical break-up actuator breaking up the pressurized fluid into a mist. Through this prepressure operation, it is assured that in each case there is sufficient pressure so that proper atomization takes place in the mechanical breake-up atomizer.

However, if the operator moves the actuator slowly, rather than dispensing a single puff of atomized fluid, a number of puffs, one after the other, are dispensed. This prevents reliably dispensing a one-shot measured dose. There is a desire and need for a pump which will dispense essentially all of the material in the pump chamber in a single puff. Such a pump more nearly approximates operation of metered pressurized dispensers which the public has considered preferable in many cases, but which from an environmental standpoint, are undesirable. Furthermore, in most medical applications, where a controlled dose is necessary, a single puff pump in which all of the material is dispensed in one dose is critically essential. Furthermore, there is a need for good pressure to insure that the proper atomization is maintained over the full dispensing stroke.

An additional problem which has faced manufacturers of this type of pump is that of atomizing heavier materials, such as oil, e.g., oils used for spraying in a frying pan, for example, to coat it before cooking. Because these are heavier than the typical material atomized, e.g., perfume or the like, a higher pressure is needed to break them up into small particles. However, it has been found that the typical user cannot properly operate a pump dispenser if the required operating pressure is excessive, i.e., above about five or six pounds. Thus, there is also a need for a dispenser which will dispense heavier liquids and permit their atomization without requiring a finger pressure in excess of five or six pounds.

SUMMARY OF THE INVENTION

The present invention provides a prepressure pump which dispenses in a single puff. This pump is also capable in some embodiments, of achieving the high pressures necessary to dispense heavier materials, such as oils, without requiring excessive finger pressure. A controlled dose with sufficient pressure to atomize the material is, thus, provided and is especially useful in medical applications, where the ability to accurately and repeatably dispense a measured dose is critical.

The present invention accomplishes one puff dispensing by creating a sticking force against which the operator's finger acts and then at a point where there is sufficient pressure build up, releasing the sticking force, reducing by a significant amount the force against which the finger acts, e.g., by a factor of 2, so that it is essentially impossible to stop the full stroke of finger movement. In the illustrated embodiment, the sticking force is an hydraulic pressure. Thus, preferably, this reduction is accomplished through a control of the relative areas on which the pressure acts.

In prior art prepressure pumps, the area of the point at which the outlet through the stem was sealed has been kept to a minimum. It has generally been thought that this is desirable since it is generally easier to effectively seal a smaller rather than larger area. What this means is that, in the prior art, the area available for the pressure mechanism to act against the biasing force and open the outlet is not substantially different than the area available immediately after opening. Thus, continued force by the user at about the same level is necessary to keep the pump operating against the spring force over its full stroke. If the user firmly and decisively pushes down on the actuator, a single puff will result. However, if the pressure is applied slowly and not smoothly a series of puffs result and the operator can vary the dose considerably.

In accordance with the present invention, the sealing area at the outlet is increased substantially, e.g. over ten times. This increase in the sealing area has a number of effects. First of all, it reduces the effective piston area. The reduction of effective piston area results in an increased pressure for a given finger force. It also decreases the area of the valve member on which the pressure acts before opening. This, in turn, permits the use of a lighter spring for a given pressure. When the valve does open, the area available for the pressure to act upon is increased substantially. Although, after opening, the pressure will drop somewhat due to the flow, there is a resistance to flow, particularly because of the break-up actuator. The pressure in the chamber, thus, acts on a much greater area, developing a greater force, which acts against the valve member and drives the valve member down against biasing spring which, as noted above, can already be of a smaller force. The result, as far as the finger is concerned, is similar to the result where one is pushing against something and overcomes static friction. It is essentially impossible for the average person to control the resulting finger movement which occurs after having built up force in the finger with the back pressure released to the extent it is. The result is that a full stroke is accomplished immediately with a single puff of finely atomized spray, atomization taking place at a higher pressure than in prior art pumps.

The spring, however, must have a minimum strength to return the piston to its rest position. In a pump of the type described in U.S. Pat. No. 4,113,145, where refilling does not take place until the piston is almost in its rest position, a certain spring force is needed to overcome the partial vacuum which is created as the piston moves upwardly. However, an even weaker spring can be utilized in a case where an arrangement is utilized where immediate filling takes place. This arrangement could be that disclosed in U.S. Pat. No. 4,230,242. However, preferably, the sliding inlet seal of U.S. Pat. No. 4,389,003 is utilized for this purpose. In conjunction with the lighter spring, the area on which the pressure acts to operate the valve member can be decreased even further as can the area on which the piston acts. As a result, for a given finger force, greater pressure can be built up in the chamber. In other words, the finger force is used primarily for building up pressure in the chamber, not for acting against the spring. As a result, the dispensing of heavier material, such as oil in a fine spray, becomes possible. The use of the sliding inlet seal in this embodiment is particularly attractive since the increased pressure in the pump chamber beneficially aids in maintaining the seal necessary at the sliding inlet seal to prevent backflow. Thus, the control of the area ratios, the lighter spring and the sliding inlet seal all work together to give a benefit previously unobtainable in pumps of this nature with a relatively low finger force on the order of five or six pounds.

DETAILED DESCRIPTION

Figure 1:
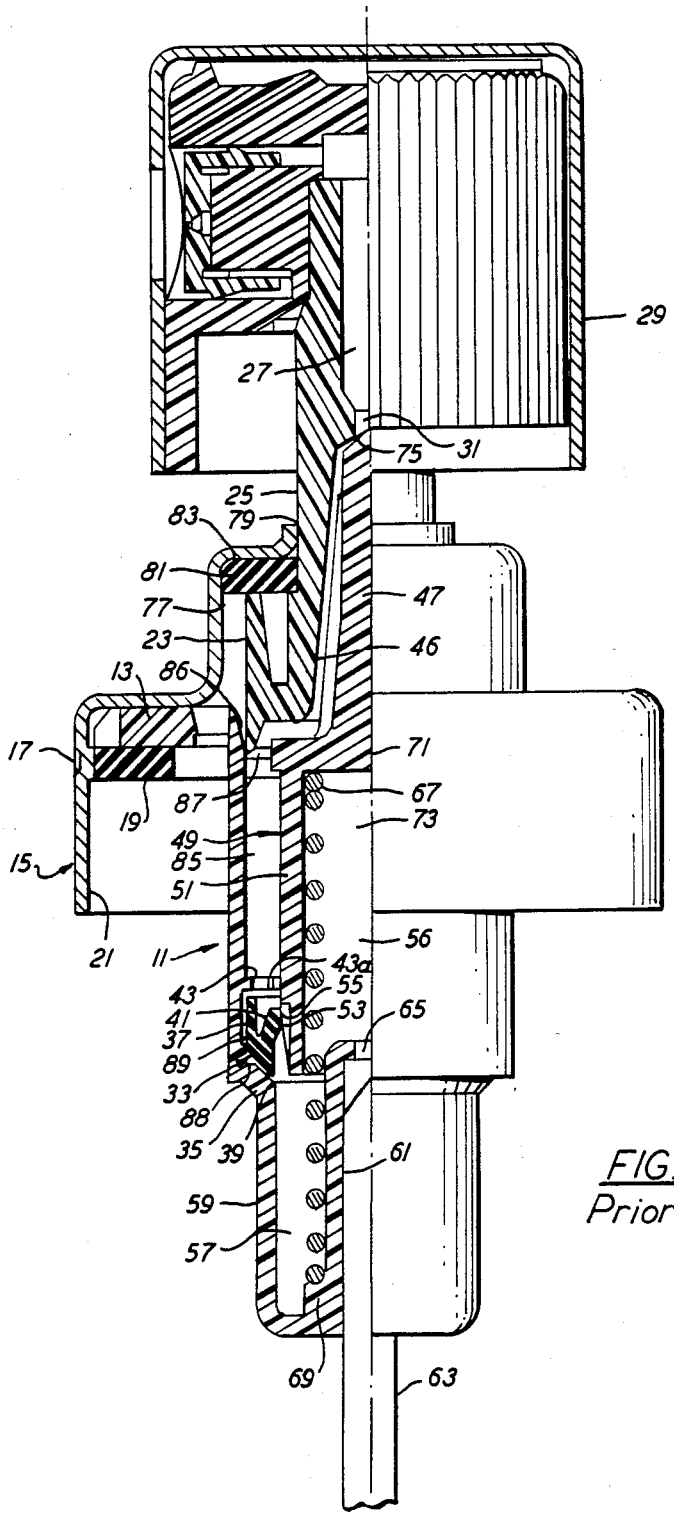
FIG. 1 Prior Art
FIG. 1 is an elevation view partially in cross section of a prior art pump of the type described in U.S. Pat. No. 4,389,003.

FIG. 1 is an elevation view, partially in cross section, of a prepressurized pump having the sliding inlet of U.S.

Pat. No. 4,389,003. More details concerning the manner in which such a pump operates may be found in U.S. Pat. No. 4,274,560, the disclosure of which is hereby incorporated by reference. The pump assembly shown in the Figure includes a pump body 11, preferably made of plastic. The pump body 11 includes a flange portion 13 which is disposed in a mounting cup 15. The illustrated mounting cup is made of metal. However, mounting cups of plastic are also possible. The flange 13 is designed so as to snap behind indentations 17 formed in the mounting cup. Disposed below the flange 13 is an annular gasket 19 which seals against the top of a container when the pump is mounted by crimping the downwardly depending portion 21 of the mounting cup around the lip of a metal or glass bottle.

Disposed for reciprocal motion within the pump body 11 is a piston 23. The piston 23 is integral with a dispensing stem 25 which contains a dispensing passage 27 in communication with an atomizing nozzle 29 in conventional fashion. An inlet port 31 is provided at the lower end of the passage 27.

At the bottom of a pump chamber 85 in the pump body 11, an annular flexible seal 33 is disposed. Seal 33 is preferably made of a soft plastic material. At this point, the pump body has a portion 35 which angles inwardly. In the illustrated embodiment, the annular flexible seal 33 has an outer cylindrical portion 37, a downwardly angled portion 39, which matches the angle of the angled portion 35 of the pump body, and an inwardly projecting annular seal lip 41. In the illustrated embodiment, the outer diameter of the portion 37 is smaller than the inner diameter of the pump body at that point. Molded within the pump body 11 is an annular projection 43 which acts as a stop for the top end of the portion 37 of the annular seal.

The piston 23 and stem 25 form a piston and stem assembly 45 which has a central opening 46 therein. Projecting into central opening 46 is the upper part 47 of a valve member 49, preferably made of plastic. The valve member also has a lower portion 51 of a cylindrical shape which projects through the throat formed by the annular inwardly projecting sealing portion 41 of the annular seal 33. For proper sealing, one of the two members, i.e., the seal 33 and valve member 49, should be softer than the other. Typically the seal 33 will be made of a softer plastic than valve member 49. However, the reverse is also possible. Portion 53 of the valve member 49 is of a generally cylindrical shape. However, at the bottom it contains a tapered section 53 in which may be formed at least one slot 55 which bypasses the edge of the sealing portion 41 of the seal 33. In the bottom portion 53 of the valve member 49 there is a central cylindrical recess 56. In the area of the pump body below the seal 35 is an annular space 57. This annular space 57 has an outer wall 59 and an inner wall 61 both of cylindrical shape. Inserted into the space formed by the inner wall 61 is a dip tube 63 which communicates with the container on which the pump is mounted. Directly above the dip tube 63 is an inlet port 65 communicating with the recess 56 beneath the valve member 49 and also with the annular space 57. A spring 67 extends between a step 69 formed in the annular space 57 and the top surface 71 of the recess 56 beneath the valve member 49. The upper portion 47 of the valve member 49 contains a beveled portion 75 at its tip which seals against the edge of the port 31.

In an at rest position, the spring 67 acts against the valve member 49 which in turn acts against the stem and piston assembly 45 to move the piston fully upward as shown in the drawing. The piston in this position is within a section 77 of the mounting cup of reduced diameter. This section of the mounting cup contains a central opening 79 through which the stem 25 passes. As illustrated, there is a gap between the central opening 79 and the stem 25 which is necessary for venting the container. The top of the piston 23 rests against a sealing diaphragm 81 disposed between it and the top 83 of the smaller section 77 of the mounting cup 15. In the position shown, this results in a seal to prevent leakage of material out of the pump when not in use. Venting during operation can be carried out by any of the venting arrangements illustrated in U.S. Pat. No. 4,113,145. Note also that the inside of pump chamber 85 has a taper 86 at the top. Thus, when the pump is operated the skirt 87 of piston 23 flexes inwardly. If due to excessive heat, skirt 87 takes a set to the diameter of lower part the pump chamber 85, it would lose contact with the taper 86.

In the pumps, such as that shown in U.S. Pat. No. 4,274,560, the seal 33 was fixed in place within the pump body. Between this seal 33, piston 23 and the walls of the pump body 11, the pump chamber 85 is formed. In that arrangement, on the dispensing stroke, as the bottom portion 51 of the valve member 49 is moved downwardly, the passage or channel 55 is closed off and material within the pump chamber 85 is pressurized. As pressure builds up, the valve member 49 moves downward to move the bevel 75 away from the port 31 to allow fluid to be dispensed when a certain predetermined pressure is reached. On the return stroke the seal between the member 33 and the lower portion 51 of the valve member is maintained until the valve member 49 and piston 23 are almost in the fully raised position shown on the drawing, i.e., until the edge of the channel 55 has passed the edge of the member 41.

However, in the illustrated embodiment, the annular flexible seal 33 is mounted within the pump body 11 in such a manner that it can slide over a short distance. Its limit of travel is established by the angled edge 35 at the bottom of pump chamber 85, and the annular projection 43 which acts as a stop. In essence, the ability to slide is accomplished by placing the projection 43 a distance above the bottom, or above the angled portion 35, which is greater than the vertical dimension of the annular seal 33 in the same direction. Thus, in FIG. 1, the annular seal is shown in its fully upward position against the stop at which point a gap 88 is open between the angled portion 39 of the seal and the angled portion 35 of the pump body 11. This gap 88 forms a passage for fluid which has filled the recess 56 and space 57. The passage is continued as one or more passages 89 in a channel or plurality of channels formed between the wall of the pump body 11 and the vertical portion 37 of the annular seal. This channel can be formed by making the outer diameter of the portion 37 smaller than the inner diameter of the pump body 11 at that point, by forming channels in the vertical portion 37 or by forming channels in the wall of the pump body 11.

With this arrangement, on the downward or inward stroke of the piston, moving from the position shown in the drawing, the friction between the lower portion 53 of the valve member 49 and the annular seal 33 will move the seal 33 downward so that its angled portion 39 comes into abutment with the angled portion 35, forming a seal. As the piston 23 continues to move downward, the pressure in the chamber 85 above the seal 33 will act to hold it tightly against the angled portion 35 of the pump body 11. The seal between the annular projecting portion 41 and the lower part 51 of the valve member 49 will be as before and prevent communication over the path.

On the return stroke, as the valve member 49 begins to move upward, and with it the piston 23, it will tend to pull the annular seal 33 along with it. This effect will be enhanced by the partial vacuum which is created in the chamber 85. When this occurs, the annular seal 33 will move away from the angled portion 35 of the pump body 11 opening up the gap 88 which is in communication with the channel 89 permitting immediate refilling of the pump chamber 85 from the fluid which is in recess 57 and space 56. Naturally, as fluid is removed therefrom it will refill from the dip tube 63 through the port 65. Thus, under all conditions, the filling of the pump chamber 85 is reliably insured.

Passage 27 communicates with a mechanical break-up actuator 101 of conventional design which breaks the liquid material being dispensed into a fine mist. This, of course, also creates a back pressure within the passage 27, particularly after a first operation when the passages remain filled with liquid. The seal at which the bevel portion 75 seals against the portion 31 was kept relatively small in prior art devices. Typically, in a commercial embodiment of a pump of this nature this sealing point has a diameter of 0.04 inches. The diameter of the lower portion 51 of the valve member 49 is typically 0.180 inches and the inner diameter of the pump body or diameter of piston 23 on the order of 0.30 inches.

Typical spring force for the spring 67 is 1-½ pounds. The area on which the piston 23 acts will be the area of the piston less the area at the point of the seal 75. The cross section area of the piston is approximately 0.0707 in.$^2$ The area of the port is 0.00125 in.$^2$ Thus, the remaining area is approximately 0.0693, in.$^2$, on which a five pound finger force, for example, works. Five pounds of finger force will, thus, result in a pressure within the chamber of approximately 72.15 pounds per square inch. The area on which this is acting in an attempt to move the valve member 49 inwardly against the force of the biasing spring 67 is the area of the portion 51 minus the outlet port area at 75. The cross sectional area of portion 51 in the example given is 0.0254 in.$^2$. Subtracting the outlet port area, leaves an area of 0.0242in.$^2$ against which the pressure of 72.15 pounds/in.$^2$ acts. This builds up a force of approximately 1.75 pounds. As noted, typically, an 1-½ pounds spring is used, the remaining portion of the force being necessary to overcome static friction.

Figure 2:
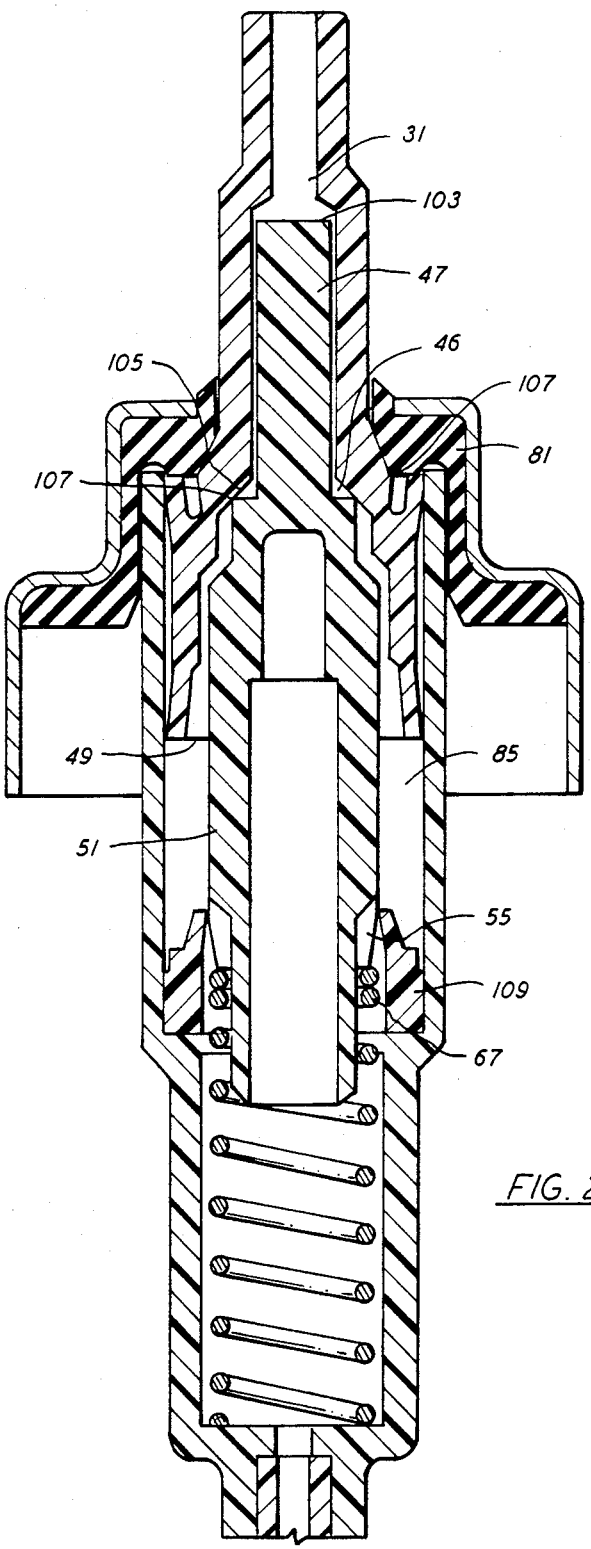
FIG. 2 is a cross section of a similar pump incorporating the present invention.

FIG. 2 is a cross sectional view of a pump according to the present invention. Parts which have the identical function of those of FIG. 1 are given the same reference numeral. In addition, only as much of the pump as is necessary to understand the differences between this embodiment and that of FIG. 1 will be described. The first thing to note is that the seal is not formed at the port 31. The upper portion 47 of the valve member no longer extends this far, but is terminated in a flat portion 103 spaced from the port 31. Instead, within the central opening 46 of the piston 23, a beveled surface 105 is formed. The valve member 49 is formed with a step portion, forming a sealing edge 107 which seals against the bevel 105. It is through the control of the diameter of this portion that the advantages of the present invention are obtained. In an experimental version of a pump with the other dimensions the same as those given above, the diameter of the valve member at the point of sealing edge 107 was made to be 0.14 inches. Thus, the cross sectional area at the seal was 0.01539 in.$^2$. This leaves an area for the piston 23 to act upon of 0.0553 in.$^2$. With the same five pounds force exerted by the finger, the pressure within the pump chamber will now reach 90.41 pounds per square inch. The area on which this is acting, i.e., the difference between the area of the lower portion 51 and the sealing area at 107 is approximately 0.0.01 in.$^2$. This results in a force of approximately 0.90 pounds. Thus, a spring of less than one pound strength can be utilized in the embodiment. Despite the lighter spring, the pressure within the chamber reaches an even higher level to carry out better atomization. The spring can now be designed merely to return the piston and valve member to their original position and create a seal. Extra force to insure atomization is not needed. Instead this force has been built up hydraulically.

To understand the manner in which the present invention operates, consider what occurs in the case of the FIG. 1 embodiment, when the spring force is overcome and the valve member 49 moves inwardly to open up the port 31. Particularly on a dispensing stroke after the first, the chamber 27 will be filled with fluid. Thus, upon initial opening before any considerable flow occurs, the pressure which was built up in the chamber, i.e., approximately 72 pounds per square inch, will remain at that level, at least momentarily. This pressure will act on the area that it had been acting upon previously, plus the additional area of the port which was previously sealed. As noted above, the back pressure created by actuator 101 prevents an immediate drop in pressure. In the case of the embodiment of FIG. 1, this additional area is 0.00125 in$^2$. This increase in area will give less than a 1/10 of a pound increase in the force acting against the spring 67. If the operator does not move his finger decisively, as movement slows down, the pressure will drop and the valve will close, i.e., the port 31 will be closed off until additional pressure builds up to again move the valve member inwardly. The result is a series of puffs of atomized material.

As noted above, the pump of FIG. 2 shows only the differences from the pump of FIG. 1. Thus, in the pump of FIG. 2 there will also be a mechanical break-up actuator which will create a back pressure which will prevent the pressure from dropping immediately and thus the pressure will remain elevated to act on the increased surface area.

In the case of the embodiment of the present invention, however, when the valve initially opens, the additional area available is 0.015 in.$^2$. This is an area greater than the area that was initially available for the pressure to act upon increasing from 0.010 to 0.025 a factor of over 2:1. The result is approximately an additional 1.4 pounds of force acting against the 1 pound spring. Up until this point, there was a resistance to movement and the operator's finger was pressing against the stem that was building up hydraulic pressure or, in a sense, "sticking". When the valve opens, the hydraulic pressure acting on the greater surface area increases the force on the stem by a factor of about 2½ times the force needed to overcome the biasing of the spring. As a result, the valve member moves inwardly rapidly and it is almost impossible to stop the movement of the finger inwardly for the full stroke of the pump, the dispensing of a single puff of atomized liquid with the atomizing taking place at a higher pressure than in the prior art devices.

In FIG. 2, the pump is shown with a seal 109 at the inner end of the pump chamber which is not a sliding seal. Thus, refilling of the pump chamber 85 does not take place until the pump is almost returned to its unoperated position by the spring 67. Filling takes place through the channels 55. As a result, the spring must be sufficiently heavy to overcome the partial vacuum which is built up in the pump chamber 85 as it is returned to its unoperated position. This, then, puts a limit on the minimum spring force necessary and in turn limits the amount of pressure which can be built up within chamber 85 for a given finger pressure. For example, consider increasing the diameter of the seal 107 to 0.16 inches. The seal area is then approximately $0.0201in^2$. Thus, the piston has an area of approximately 0.0505 over which it is operating on the fluid in the pump chamber. This will, with the desired five pound finger pressure, build up approximately 119 pounds in the pump chamber. This 119 pounds operates on an area of approximate $0.0053in^2$, the difference in the area of the lower portion 51 of the valve member and the area of the seal at 107. This will generate approximately 0.63 pounds of force. Thus, a spring with a force of less than ½ pound would have to be used in this instance, considering that a certain amount of the force is necessary to overcome static friction. However, a spring this light can not reliably return the piston to its rest position because of the partial vacuum in chamber 85. If, the spring force is increased, with everything else remaining the same, then the force against which the finger must act is also increased, this being undesirable.

Thus, in accordance with the present invention, particularly in cases where a higher pressure build-up is needed to dispense certain material, such as oils, a type of inlet valve or inlet seal which permits refilling of the chamber, immediately upon the beginning of the return stroke is utilized. Preferably, this is the type of sliding inlet seal shown in FIG. 1. However, other constructions, such as that shown in U.S. Pat. No. 4,230,242 may also be used. With such a sealing or valving arrangement, the lighter spring of, for example, one-half pound can be used, and will still return the piston to its rest position reliably and will also result in a sufficient seal of the upper end of the piston 23 against the gasket 81. This will permit further increasing the diameter at the sealing edge 107 to cause a further build-up of pressure permitting dispensing of the heavier materials.

The use of the sliding inlet seal is particularly attractive in this instance, because such a seal works better the higher the pressure.

In the example just given, the area against which the pressure within the chamber acts on the valve member pushing it inwardly against the spring increases from 0.0053 when the valve is closed to 0.0254 when the valve is open. These areas are respectively the area of the lower portion 51 and the area of the lower portion less the area sealed at the outlet port. The ratio here is almost 5:1. In the previous example, the increase was approximately 2½:1. It is believed that best results will be obtained if this ratio of the area with the valve opened to the area with the valve closed is at least 1.5 and preferably at least 2. For a finger operated pump the dimensioning should be such that the finger force which must be excerted does not exceed 5 to 6 pounds. Typically, this can be accomplished in pumps with piston diameters up to about 0.35 inches in diameter. In such a case, for example, the seal diameter would be approximately 0.25 inches. With pumps of this nature, quantities up to about 200 microliters can be dispensed.

However, the present invention is also applicable to trigger pumps operating on this same principle. As is well recognized in the art, with a trigger pump an operator can develop greater forces. Such pumps have larger diameters and dispense larger quantities of material. The present invention can also be implemented in these types of pumps. In such cases, the actuating force will be greater due to the mechanical advantage of the trigger mechanism to account for the greater area. However, if the aforementioned ratios are maintained the same effect of a materially increased pressure on the valve member resulting in the uncontrolled motion of the finger will occur. Also, although disclosed in connection with a vented container, the pump of the present invention can also be used in a nonvented configuration, e.g., with a collapsible bag such as shown in U.S. Pat. No. 4,008,830.

What is claimed is:

1. A pump for use with a container of liquid material for dispensing and atomizing the liquid material in an accurate dose per operation comprising:

(a) means defining a pump chamber of substantially fixed volume, with a closed radial sidewall and an inner end, said pump chamber having an opening at its inner end;

(b) means for filling said pump chamber;

(c) a pump stem having a piston on one end thereof disposed for reciprocal motion in said pump chamber;

(d) said pump stem having a passageway therethrough with a dispensing outlet at the outer end of said passageway and an axial inlet port located inwardly thereof;

(e) a rigid valve member having a first end portion cooperating with said axial inlet port to close off said axial inlet port and a second end portion of a predetermined cross-sectional sealing area, the axial length of said second end portion of predetermined cross-sectional area being at least equal to the range of movement of said pump stem over which dispensing occurs;

(f) means forming a seal at said opening at the inner end of said pump chamber, said second end portion of said valve member passing through said seal where said second end portion is sealingly guided;

(g) means for supplying liquid in a container to said means for filling;

(h) means biasing said valve member outwardly so that the first end portion thereof closes off a cross-sectional area of said axial inlet port;

(i) the cross-sectional area closed off at said axial inlet port being smaller than the cross-sectional area of said second end portion of said valve member where it is sealingly guided, whereby, as said pump is operated by said pump stem, the pressure in the pump chamber is increased until, at a predetermined pressure, said means biasing said valve member is overcome and said valve member is moved away from said pump stem to open said axial inlet port and permit pressurized material to be discharged through said passageway and dispensing outlet; and (j) means for causing the force necessary to move said stem inwardly before said port is opened to be at least 1.5 times the force needed to move said stem when said inlet port is opened.

2. Apparatus according to claim 1, wherein said means for causing comprise the ratio of the area of said second end portion to the area of said second end portion less the area closed off at said inlet port being at least 1.5 to 1.

3. Apparatus according to claim 2, wherein said ratio is at least 2 to 1.

4. Apparatus according to claim 3, wherein said means forming a seal comprises an annular flexible plastic seal.

5. Apparatus according to claim 4 wherein said annular flexible plastic seal has a sealing point disposed above the inner end of said pump chamber, said annular seal extending at an angle to a central axis through the pump chamber, axially outward from the bottom of said chamber and radially inwardly from the sidewall of said chamber, whereby radial flexing outward of said seal is possible, forming a throat at the inner end of said chamber where said second end portion is guided, said second end portion cooperating with said throat to seal the bottom of said pump with a surface to surface seal at said throat as said pump is operated by depressing said pump stem to prevent any flow from said pump chamber through said throat when said pump is dispensing.

6. Apparatus according to claim 5, wherein said means for filling includes a further chamber inward of said pump chamber having an opening at its outer end adjacent the opening at the inner end of said pump chamber and adapted to be put into communication with the container at the inner end thereof to place said container in communication with said throat, and means formed at the end of said second end portion to permit communication from said further chamber through said throat and into said pump chamber when said means biasing said valve member are maintaining said stem in a fully outward position.

7. Apparatus according to claim 6, wherein the second end portion of said valve member contains a hollow recess and wherein said biasing means comprises a spring disposed within the hollow recess of said second end portion extending to the inner end of said further chamber.

8. Apparatus according to claim 7, and further including an additional portion on said stem extending outwardly of said axial inlet port, said additional portion having a bore formed therethrough; and actuator and atomizing means disposed on the end of said additional portion.

9. Apparatus according to claim 6, wherein said means formed at the end of said second end portion comprises a channel.

10. Apparatus according to claim 6, wherein said means defining a pump chamber, said pump stem and piston, and said valve member are each of molded plastic construction.

11. Apparatus according to claim 10, wherein said valve member is a one piece member.

12. Apparatus according to claim 11, wherein said annular seal is made of a material which is softer than the material of said valve member.

13. Apparatus according to claim 12, wherein said annular seal is made of low density polyethylene and said valve member of polypropylene.

14. Apparatus according to claim 4, wherein the annular seal in said pump chamber is mounted for sliding motion therein along said sidewall between a first inward position where it seals against said pump chamber and a second outward position where it establishes a path of communication from below said opening into said chamber, a gap between the inner end of said pump chamber and the bottom of said flexible seal and at least one channel bridging the remainder of said seal; an annular projection formed on the inside of said sidewall of said pump chamber, spaced from the inner end of said chamber a distance greater than the dimension of said annular seal in the same direction limiting the sliding motion of said annular seal, to thereby form said valving means.

15. Apparatus according to claim 14 wherein said annular seal comprises a vertical portion of an outer diameter at least slightly less than the inner diameter of said pump chamber, a second portion extending inwardly and downwardly therefrom and a third sealing portion extending upwardly and inwardly from said inwardly and downwardly extending portion and forming a sealing edge contacting said valve member, the inner end of said pump chamber extending downwardly at the same angle as said inwardly and downwardly extending portion whereby during pump operation a seal will be made between said inwardly and downwardly extending portion and said inner end of said pump chamber.

16. Apparatus according to claim 14, wherein said channel comprises a gap between outer diameter of said annular seal and the inner diameter of the adjacent portion of said pump body.

17. Apparatus according to claim 14, wherein said channel comprises at least one bypass channel formed in said annular seal.

18. Apparatus according to claim 14, wherein said channel comprises at least one bypass channel in the side wall of said pump body adjacent said annular seal.

19. Apparatus according to claim 1 wherein said valving means are adapted to open as soon as said piston begins its return stroke.

20. A pump for use with a container of liquid material for dispensing and atomizing the liquid material in a single puff per actuation, comprising:

(a) means defining a pump chamber of substantially fixed volume having a wall, said pump chamber having an opening at its inner end being of essentially constant inner diameter;

(b) an annular flexible plastic seal flexibly inserted at the inner end of said pump chamber said annular seal extending at an angle to the axis of the pump chamber axially outward from the bottom of said chamber and radially inwardly from the sidewall of said chamber whereby flexing radially outward of said seal is possible, said annular flexible seal forming a throat at the inner end of said pump chamber;

(c) a pump stem having a piston on the end thereof disposed for reciprocal motion in said pump chamber;

(d) said pump stem having a passageway therethrough with a dispensing outlet at the outer end of said passageway and an inlet port located inwardly thereof;

(e) a rigid valve member made of plastic having a first end portion cooperating with said inlet port to close off said port and a second end portion of a predetermined cross-sectional sealing area, the axial length of said second end portion of predetermined cross-sectional area being at least equal to the range of movement of said pump stem over which dispensing occurs;

(f) said annular seal guiding said second end portion, said second end portion cooperating with said throat to form sealing means at the inner end of said pump chamber with a surface to surface seal as said pump is operated by depressing said pump stem to prevent any flow from said pump chamber through said throat when said pump is dispensing;

(g) a further chamber inward of said pump chamber having an opening at its outer end adjacent the opening at the inner end of said pump chamber, said further chamber adapted to receive a dip tube at its inner end to place said dip tube in communication with said throat;

(h) means at the inner end of said second end portion to permit communication from said further chamber through said throat and into said pump chamber when said stem is in a fully outward position;

(i) means biasing said valve member outwardly so that the first end portion thereof closes off said inlet and thereby also biasing said pump stem outwardly;

(j) the cross-sectional area closed off at said inlet port being smaller than the cross-sectional area of said second end portion of said valve member where it is sealingly guided, whereby, as said pump is operated by pressing said pump stem, the pressure in the pump chamber is increased until, at a predetermined pressure, said biasing is overcome and said valve member is moved away from said pump stem to open said inlet port and permit pressurized material to be discharged through said passageway and dispensing outlet; and (k) the ratio of the area of said second end portion to the area of said second end portion less the area closed off at said inlet port being at least 1.5 to 1.

* * * * *